US010106304B2

(12) United States Patent
Moskovich et al.

(10) Patent No.: US 10,106,304 B2
(45) Date of Patent: Oct. 23, 2018

(54) ORAL CARE IMPLEMENT PACKAGE

(71) Applicant: Colgate-Palmolive Company, New York, NY (US)

(72) Inventors: Robert Moskovich, East Brunswick, NJ (US); Daniel Wainless, New Brunswick, NJ (US); Alan Sorrentino, Cranbury, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/738,101

(22) PCT Filed: Jun. 23, 2015

(86) PCT No.: PCT/US2015/037225
§ 371 (c)(1),
(2) Date: Dec. 19, 2017

(87) PCT Pub. No.: WO2016/209216
PCT Pub. Date: Dec. 29, 2016

(65) Prior Publication Data

US 2018/0178964 A1 Jun. 28, 2018

(51) Int. Cl.
*B65D 83/10* (2006.01)
*B65D 75/36* (2006.01)
(Continued)

(52) U.S. Cl.
CPC ..... *B65D 75/366* (2013.01); *A46B 15/0091* (2013.01); *B65D 75/563* (2013.01); *A46B 2200/1066* (2013.01); *B65D 2575/565* (2013.01)

(58) Field of Classification Search
CPC ..... B65D 75/366; B65D 75/563; B65D 2575/565; A46B 15/0091; A46B 2200/1066
(Continued)

(56) References Cited

U.S. PATENT DOCUMENTS 5,429,241 A 7/1995 Althaus
6,059,106 A * 5/2000 Baker ..... A45D 44/18 206/361
(Continued)

FOREIGN PATENT DOCUMENTS

DE 9300149 5/1994
EP 0 327 479 8/1989
(Continued)

OTHER PUBLICATIONS

Author Unknown, tootbrush Blister Packaging, Alibaba.com, http://www.alibaba.com/product-detail/toothbrush-Blister-Packaging_60003405034/showimage.html, accessed Apr. 20, 2015, 1 page.
(Continued)

*Primary Examiner* — Luan K Bui

(57) ABSTRACT

A package (100) for an oral care implement such as one or more toothbrushes can include a transparent or translucent front panel (102) having a flat surface at a consumer-facing side of the package. The package can further include a transparent or translucent back panel (104) attached to the front panel, the back panel having a contoured surface, as well as text and/or graphics (116) on the front panel, wherein the package is configured to be displayed with the front panel of the package facing a viewing location. The front panel can further include an opening tab (120) defined by a tab line (122), a flap (126) defined, at least in part, by the tab line, and an opening cavity (124) in the back panel that is positioned behind the flap.

8 Claims, 2 Drawing Sheets

(51) Int. Cl.
*B65D 75/56* (2006.01)
*A46B 15/00* (2006.01)

(58) Field of Classification Search
USPC ..... 206/209, 361, 362, 362.1, 362.2, 362.3, 206/461, 470, 471, 806
See application file for complete search history.

(56) References Cited

U.S. PATENT DOCUMENTS

| | | | | |
|---|---|---|---|---|
| 6,311,837 | B1 * | 11/2001 | Blaustein | B65D 75/36 15/28 |
| 6,889,829 | B2 | 5/2005 | Lev et al. | |
| 8,511,467 | B2 | 8/2013 | Sorrentino et al. | |
| 8,919,558 | B2 | 12/2014 | Bloch et al. | |
| 9,751,676 | B2 | 9/2017 | Bow et al. | |
| 2001/0032796 | A1 | 10/2001 | Rubenstein | |
| 2003/0205492 | A1 * | 11/2003 | Ferber | A61C 17/22 206/362.2 |
| 2003/0221983 | A1 * | 12/2003 | Chan | A61C 17/22 206/361 |
| 2005/0087464 | A1 * | 4/2005 | Brattesani | B65D 75/54 206/361 |
| 2005/0145519 | A1 * | 7/2005 | Fattori | B65D 25/20 206/361 |
| 2005/0161313 | A1 * | 7/2005 | Sorrentino | A61C 17/221 200/332 |
| 2010/0230312 | A1 | 9/2010 | Sorrentino et al. | |
| 2012/0048760 | A1 * | 3/2012 | Karey | A46B 15/0091 206/361 |
| 2012/0111754 | A1 | 5/2012 | Domerchie et al. | |
| 2013/0256165 | A1 | 10/2013 | Moskovich | |
| 2014/0083885 | A1 | 3/2014 | Lee et al. | |
| 2017/0050791 | A1 * | 2/2017 | Nguyen | B65D 75/5833 |

FOREIGN PATENT DOCUMENTS

| | | |
|---|---|---|
| FR | 2 737 197 | 1/1997 |
| WO | 2012/166085 | 12/2012 |
| WO | 2015/072965 | 5/2015 |

OTHER PUBLICATIONS

International Search Report and the Written Opinion of the International Searching Authority issued in PCT/US2015/037225 dated Dec. 1, 2015.

* cited by examiner

ORAL CARE IMPLEMENT PACKAGE

BACKGROUND

Oral care implements or items such as toothbrushes can be packaged and displayed either singly or in multiples of two or more within a blister package. One common blister package can include a cardboard backer and a clear polymer consumer-facing side that provides a bubble structure through which the toothbrush may be viewed. The consumer-facing side is typically contoured to receive the toothbrush and hold the toothbrush in place during shipping and display. In such structure, the toothbrush lays on the top of the backer, and bristles of the toothbrush are positioned to face, and are viewed through, the contoured consumer-facing side. The backer may be decorated with display graphics to be viewed when the toothbrush is displayed. The display graphics printed on the cardboard backer are arranged around the perimeter or footprint of the toothbrush because, for example, graphics printed on the backer within the perimeter of the toothbrush will be blocked by the toothbrush and are not therefore visible during display of the product. While printing graphics on the polymer consumer-facing side would provide a larger print area with greater visibility, forming quality graphics on the blistered consumer-facing side is difficult. Graphics printed on a flat polymer consumer-facing side prior to thermoforming are distorted during the thermoforming process. Printing graphics on the polymer consumer-facing side after thermoforming is difficult due to the contoured shape of the consumer-facing side. Decals placed on the polymer consumer-facing side subsequent to thermoforming are relatively expensive, and reliably adhering the decals to the contoured consumer-facing side is difficult.

Additionally, while the use of blister packages has proved to be cost-effective and effective at adequately protecting the toothbrush contained within, existing blister packages can be difficult to open.

Thus, a need exists for an easy-open blister package that eliminates one or more of the aforementioned deficiencies.

BRIEF SUMMARY

The following presents a simplified summary in order to provide a basic understanding of some aspects of one or more embodiments of the present teachings. This summary is not an extensive overview, nor is it intended to delineate the scope of the disclosure. Rather, its primary purpose is merely to present one or more concepts in simplified form as a prelude to the detailed description presented later.

In an embodiment, a package for an oral care implement can include a transparent or translucent front panel having a flat surface at a consumer-facing side of the package, a transparent or translucent back panel attached to the front panel, the back panel having a contoured surface, and text and/or graphics on the front panel, wherein the package is configured to be displayed with the front panel of the package facing a viewing location.

In another embodiment, a package can include at least one toothbrush having a handle, a head, a shank connecting the head to the handle, and a plurality of bristles extending away from the head, a transparent or translucent front panel having a flat surface at a consumer-facing side of the package, and a transparent or translucent back panel attached to the front panel, the back panel having a contoured surface, wherein the at least one toothbrush is interposed between, and sealed within, the front panel and the back panel. The package can further include text and/or graphics on the front panel, wherein the package is configured to be displayed with the front panel of the package facing a viewing location, and at least one touch point between the front panel and the at least one toothbrush, wherein the touch point prevents rotation of the at least one toothbrush within the package and further prevents physical contact between the front panel and the bristles during shipping.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1A:
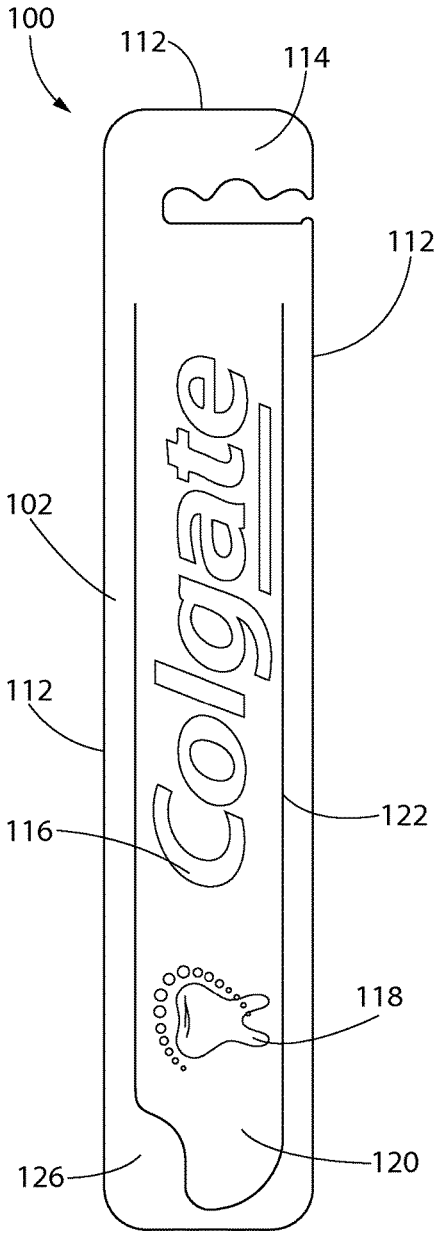
FIG. 1A is a plan view depicting a transparent flat front panel for an oral care implement package according to an embodiment of the present teachings.
Figure 1B:
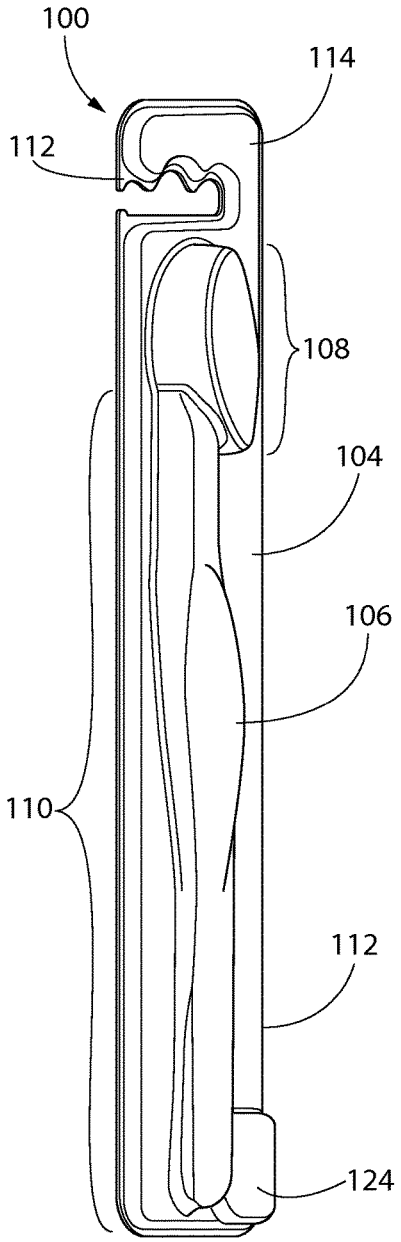
FIG. 1B is a plan view depicting a transparent contoured back panel for an oral care implement package according to an embodiment of the present teachings.

FIG. 1A is a front view, and FIG. 1B is a back view, depicting a package 100 for an oral care implement according to an embodiment of the present teachings. The depicted embodiment and the description below refer to a toothbrush for simplicity, but it will be understood that the package 100 may be applied to other oral care implements. The package 100 can include a generally flat front panel or lid 102 and a contoured back panel or tub 104. In various embodiments, the flat front panel 102 and the contoured back panel 104 may be manufactured from a clear polymer, and the front panel 102 may be manufactured from the same or a different material than the back panel 104. The clear polymer may be transparent or translucent, and may be tinted or untinted.

In an embodiment, the front panel 102 and back panel 104 may be manufactured from polyethylene terephthalate (PET), polyethylene terephthalate glycol (PETG), or another polymer. The back panel 104 can include a product cavity 106 that receives the product stored within the package 100. The product cavity 106 may be shaped and/or otherwise configured for the individual design of the oral care implement to be packaged therein. In an embodiment, the product cavity 106 may have a depth that is sufficient and appropriate for the shape and design of the product to be packaged within.

In the FIG. 1B embodiment, the product cavity 106 includes first portion 108 configured to receive a toothbrush head with bristles and a second portion 110 configured to receive a toothbrush handle. Suitable material thicknesses and the formation of a contoured back panel using, for example, a vacuum forming blister process will be evident to one of ordinary skill in the art from the description herein. The front panel 102 and the back panel 104 can be attached together. In an embodiment, the front panel 102 and the back panel 104 are fused together around the perimeter 112 of the package 100. In an embodiment, the entire perimeter 112 of the package 100 can be fused to seal the toothbrush within. As depicted in FIG. 1B, the front panel 102 and the back panel 104 can each include a flange, where the flanges are fused together using an ultrasonic fusing process or a radiofrequency fusing process. In another embodiment, the front panel 102 and the back panel 104 can be attached together using an adhesive (not individually depicted for simplicity).

The package 100 of FIGS. 1A and 1B is configured to be displayed, for example, on a hanging display rack from an integrated hook 114, with the flat front panel 102 facing the viewing location of the consumer. In other words, the flat front panel 102 is the consumer-facing portion of the package 100. In contrast to some prior packages that include a flat back panel manufactured from an opaque material such as cardboard, the product within package 100 is visible through the flat front panel 102 because the front panel 102 is manufactured from a transparent or translucent material, for example, a transparent or translucent polymer.

Additionally, because the front panel 102 is generally flat as depicted, the front panel 102 can be easily and inexpensively printed with text 116 and/or graphics 118. The front panel 102 includes a front surface (i.e., an outer package surface, FIG. 1A) and a back surface (i.e., and inner package surface, FIG. 1B), wherein the text 116 and/or graphics 118 may be printed on the outer package surface, the inner package surface, or both. In another embodiment, text 116 and graphics 118 may be embodied as decals that are attached to the flat front panel 102 on the outer package surface, the inner package surface, or both, for example, using an adhesive. This is in contrast to prior packages that are displayed with a contoured portion facing the viewing location of the consumer. As described above, printing on a blistered or contoured surface is difficult and more expensive than printing on a flat surface, and printing on a flat surface prior to blistering results in deformation of the printed image on the finished contoured surface. Further, adhering or otherwise attaching a flat decal to a contoured (e.g., blistered) surface is difficult, and the decal is likely to easily detach from the contoured surface as a result of factors such as physical contact with other surfaces during shipping or display. In an embodiment, printing and/or decals on the contoured back panel 104 are contemplated.

In another embodiment, the outer package surface of the front panel 102 may be printed with an ink, for example, in reverse print that is readable or viewable through the back panel 104. Subsequently, an opaque material, for example, an ink, a decal, or a foil such as an opaque holographic foil (not individually depicted for simplicity), may be attached to the outer package surface of the front panel 102 on top of the ink printed on the outer package surface of the front panel 102. The opaque material allows the ink to be read or viewed through the back panel 104, but prevents reading or viewing of the ink from the front, consumer-facing side of the package. In another embodiment, the inner package surface of the front panel 102 may be printed with an ink in normal print that is readable or viewable through the back panel 104. Subsequently, the opaque material may be attached to the outer package surface of the front panel 102 to prevent reading or viewing of the ink from the front of the package.

In prior packages, text and/or graphics were printed on the flat cardboard backer, which was behind the toothbrush, and thus the toothbrush blocked the view of part of the backer and limited the area available for visible text and/or graphics. The flat front panel 102 of package 100, in contrast, can be printed or decorated with decals, and the printing or decals remain visible as the front panel 102 is in front of the implement packaged within. Further, the oral care implement packaged within remains at least partially visible, or may remain entirely visible, if the printing and/or decals 116, 118 are transparent, semi-transparent, or translucent. Various inks are contemplated, for example, aqueous inks, polymer-based inks, latex inks, solid inks, etc.

To facilitate opening, the package 100 can include an opening tab 120 on the front panel 102. The opening tab 120 may be defined by a scored or perforated tab line 122 within or on a surface of the front panel 102. The tab line 122 may be formed by scoring or micro-perforating the front surface and/or the back surface of the front panel 102 using, for example, a laser, a blade, etc. The tab line 122 provides a weakened region of the front panel 102 such that, when the opening tab 120 is lifted, the front panel 102 tears along the tab line 122. To further facilitate opening of the package 100 using the opening tab 120, the back panel 104 can include an opening cavity 124 that is located or positioned behind a portion of the front panel 102. In an embodiment, the opening cavity 124 may be positioned or located behind a flap 126, where the flap 126 is defined, at least in part, by the tab line 122. As depicted in FIG. 1A, the flap 126 may be located or positioned outside a perimeter of the opening tab 120 as defined by the tab line 122. To open the package 100, a user may press the flap 126 toward the back of the package 100 to tear the front panel 102 along the tab line 122 that is adjacent to the flap 126. Because the opening cavity 124 is located behind the flap 126, a greater pressure can be exerted on the tab line 122 adjacent the flap 126 than if the back panel 104 did not include the opening cavity 124, for example, because the flap 126 can move a greater distance without physically contacting the back panel 104. The pressure placed on the flap 126 results in tearing along the tab line 122, and/or separation of the flap 126 from the opening tab 120. Once the front panel 102 tears or separates along the portion of the tab line 122 that is adjacent to the flap 126, the user can grasp the opening tab 120, for example with a finger and a thumb, then lift the opening tab 120 to tear the front panel 102 along an additional length of the tab line 122 to expose and remove the product within the package 100.

Figure 2:
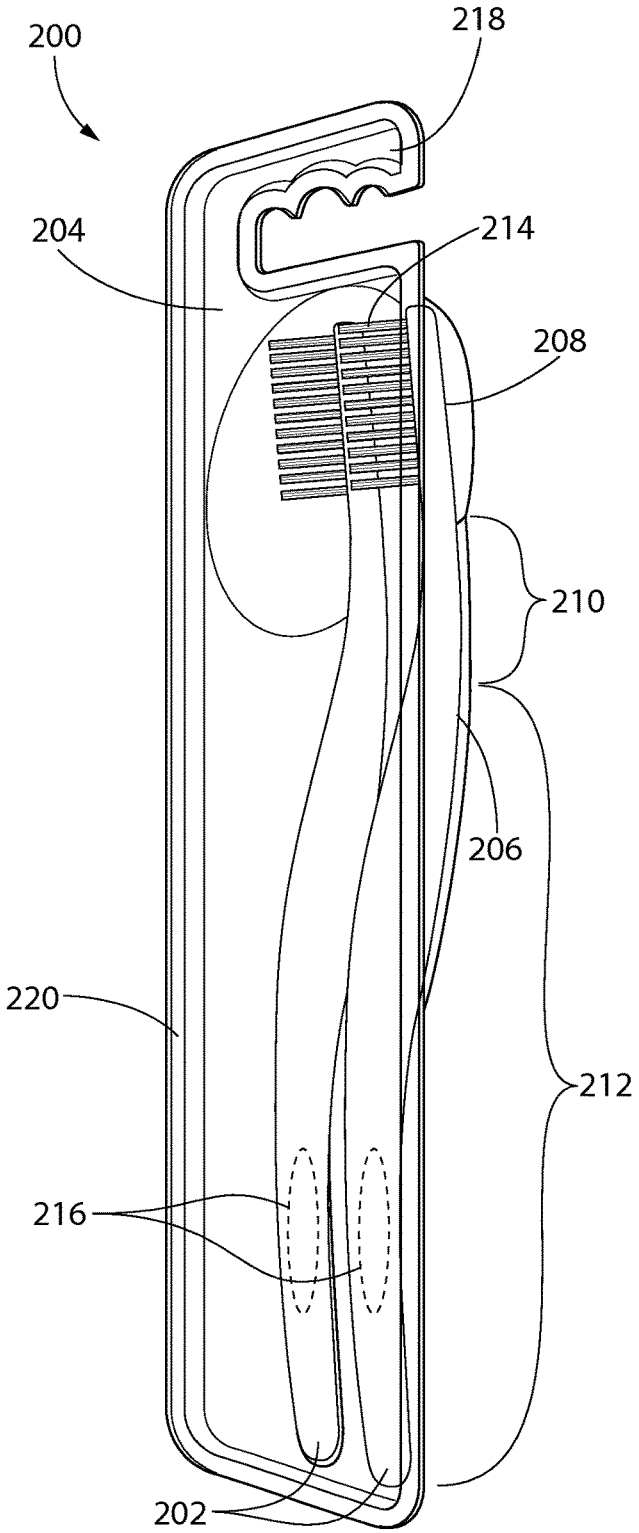
FIG. 2 is a perspective depiction of a package for one or more oral care implements according to an embodiment of the present teachings.

FIG. 2 is a perspective depiction of an embodiment of a multipack package 200 including two toothbrushes packaged within. While the package 200 of FIG. 2 depicts two toothbrushes 202, it will be understood that a package can include at least one, only one, or more than two, oral care implements. The package 200 includes a transparent flat front panel 204 and a contoured back panel 206, for example, a thermoformed, blistered back panel 206, and thus provides a two-part package 200. For clarity, text and graphics have been omitted from the FIG. 2 depiction, but a package 200 can include text and/or graphics on the flat front panel 204.

As depicted in FIG. 2, each toothbrush 202 includes a head 208, a shank 210, and a handle 212, where the shank 210 is interposed between, and continuous with, the head 208 and handle 212, and connects the head 208 with the handle 212. A plurality of bristles 214 are attached to, and extend away from, the head 208. As depicted in FIG. 2, each toothbrush 202 may be positioned within the blistered back panel 206 of the package 200 so that the bristles 214 extend away from the head 208 and toward the flat front panel 204. While the bristles 214 may or may not physically contact the front panel 204, an axis of each bristle 214 may intersect the front panel perpendicularly at an angle of 90°, or approximately so. In another embodiment, as depicted in FIG. 2, the axes of the bristles 214 may extend toward the front panel 204 and intersect the front panel at an oblique angle, for example at an angle of between about 30° and about 60°. This is in contrast to prior packages in which bristles extend away from a toothbrush head, toward a blistered consumer-facing panel, and away from a flat backer. As depicted in FIGS. 1 and 2, the contoured surface of the back panel 104, 206 is contoured to conform to a shape of at least one of, or two, or all three of, the head 208, the shank 210, and the handle 212 of the toothbrush.

As described above, conventional toothbrush packages can include a contoured front from which the toothbrush bristles are displayed and a flat backer. In these conventional packages, the bristles extend away from a head toward the contoured front of the package and away from the flat backer, and the blister front can be contoured to provide a protective bubble for the head of the toothbrush, including the bristles. The protective bubble can be sufficiently contoured to avoid any physical contact between the toothbrush bristles and the contoured front during shipping, storage, and display. Any physical contact between the bristles and the packaging may deform the bristles and detract from the appearance of the package as it is displayed for purchase. In contrast to conventional package designs, various embodiments of the present teachings include bristles that extend away from the head toward the flat surface of the front panel, and thus the flat surface of the front panel may not be contoured to protect the bristles. To reduce the likelihood of the toothbrush bristles from physically contacting the flat surface of the front panel, the toothbrush may be secured in place within the package through friction contact with the package. In an embodiment, portions of the toothbrush may be sandwiched or interposed between, and physically contacting, the flat front and the contoured back panel. Physical contact between, for example, the touch points on the handle of the toothbrush, the flat surface of the front panel, and the contoured back panel secure the toothbrush within the package to prevent shifting of the toothbrush and any resulting physical contact between the toothbrush bristles and the flat surface of the front panel. In an embodiment, a compressive pressure is exerted onto the toothbrush by inward pressure from the front panel and the back panel toward the toothbrush. As depicted in FIG. 2, the flat front panel 204 of the package 200 may physically contact each toothbrush 202 to secure each toothbrush within the package 200. In the FIG. 2 embodiment, each toothbrush 202 physically contacts the front panel 204 at only one region or "touch point" 216, for example, a portion or region on the handle 212 as depicted. The physical contact between each toothbrush 202, the touch point 216 between the toothbrush 202 and the front panel 204, and a similar touch point 216 between the toothbrush 202 and the back panel 206 along one or more of the handle 212, the shank 210, or the head 208 reduces or prevents the likelihood of the toothbrush 202 rotating within the package 200 during shipping and/or storage. Having at least one touch point 216 at a toothbrush location away from the bristles 214, for example on the handle 212, prevents damage to the bristles 214 through physical contact with the front panel 204. A package may include only one touch point 216, or at least one touch point 216, between the at least one toothbrush 202 and front panel 204, and between the at least one toothbrush 202 and the back panel 206.

To further reduce or prevent rotation of the toothbrush 202 within the package 200 using at least one touch point on the front panel or lid 204 and at least one touch point on the back panel or tub 206, the package front panel lid 204 and the back panel 206 may have a sufficient rigidity that prevents flexing of the front panel 204 and the back panel 206. The rigidity may be established by forming the front panel 204 and/or the back panel 206 from a polymer stock material that is sufficiently thick and rigid. For example, the front panel 204 and/or the back panel 206 of the completed package may have a thickness of about 0.2 mm or greater, or from about 0.2 mm to about 0.5 mm, or from about 0.25 mm to about 0.3 mm. A package having a thinner material that is insufficiently rigid may flex under the application of rotational pressure from the toothbrush 202, and may allow the toothbrush 202 to rotate out of position within the package, for example, during shipping. A thicker, more rigid material resists flexing under the application of rotational pressure from the toothbrush 202, and firmly holds the toothbrush 202 in position between the touch points of front panel 204 and the back panel 206, even under the application of significant rotational pressure from the toothbrush 202.

As described above with reference to FIG. 1A and/or FIG. 1B, the package 200 of FIG. 2 can include a hook 218. The front panel 204 and back panel 206 may be connected together around a perimeter 220 of the package 200 to seal the one or more toothbrushes 202 within the package 200. The package 200 may also include an opening cavity, a flap, a tab, and a tab line, for example as described above with reference to FIG. 1. The flap, tab, and tab line may be located on the front panel 204, while the opening cavity may be located on or formed as part of the back panel 206.

Thus, packaging for one or more oral care implements such as one or more toothbrushes in accordance with the present teachings can include a flat front panel and a contoured back panel. The front and back panels may be manufactured from a transparent, clear, or otherwise at least partially see-through polymer, or the like, that allows the product within to be viewed from most or all angles. The packaging can include printed (e.g., inked, etched, or engraved) or decal-borne text and/or display graphics on the flat front panel. Printed graphics may be formed using a pigment-based ink. Printed graphics may also be formed with an etching or engraving technique using heat applied through the use of a laser or heated tip, a mechanical abrasion technique, or chemical etching. The front panel of the package may be a flat lid. The front panel may be clear or translucent and allows the product within to be displayed, and the text and/or graphics can be visibly positioned outside the footprint, as well as over the footprint, of the product within, which is in contrast to prior blister package designs. For toothbrush packaging, the bristles of the toothbrush may extend away from the toothbrush head and toward the flat front panel. In some embodiments, the contoured or blistered back panel may be partly decorated with labels, detached inserts, or direct printing.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. As used herein, the term "one or more of" with respect to a listing of items such as, for example, A and B, means A alone, B alone, or A and B. The term "at least one of" is used to mean one or more of the listed items can be selected. Further, in the discussion and claims herein, the term "on" used with respect to two materials, one "on" the other, means at least some contact between the materials, while "over" and "overlie" mean the materials are in proximity, but possibly with one or more additional intervening materials such that physical contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

What is claimed is:

1. A package, comprising:

at least one toothbrush having a handle, a head, a shank connecting the head to the handle, and a plurality of bristles extending away from the head;

a transparent or translucent front panel having a flat surface at a consumer-facing side of the package;

a transparent or translucent back panel attached to the front panel, the back panel having a contoured surface, wherein the at least one toothbrush is interposed between, and sealed within, the front panel and the back panel;

text and/or graphics on the front panel, wherein the package is configured to be displayed with the front panel of the package facing a viewing location; and at least one touch point between the front panel and the at least one toothbrush, wherein the touch point prevents rotation of the at least one toothbrush within the package and further prevents physical contact between the front panel and the bristles during shipping.

2. The package of claim 1, further comprising at least one touch point between the back panel and the at least one toothbrush, wherein a compressive pressure is exerted onto the at least one toothbrush by the front panel and the back panel.

3. The package of claim 1, wherein each bristle of the plurality of bristles comprises an axis and the axis of each bristle intersects the front panel at an angle of between 30° and 60°.

4. The package of claim 1, wherein the front panel further comprises:

an opening tab defined by a tab line;

a flap defined, at least in part, by the tab line; and an opening cavity positioned behind the flap.

5. The package of claim 1, wherein the front panel and the back panel are fused together.

6. The package of claim 1, further comprising:

at least one touch point between the back panel and the at least one toothbrush, wherein a compressive pressure is exerted onto the at least one toothbrush by the front panel and the back panel;

wherein:

each bristle of the plurality of bristles comprises an axis and the axis of each bristle intersects the front panel at an angle of between 30° and 60°;

the front panel further comprises an opening tab defined by a tab line;

the front panel further comprises a flap defined, at least in part, by the tab line;

the back panel further comprises an opening cavity positioned behind the flap; and the front panel and the back panel are fused together.

7. The package of claim 1, wherein the contoured surface of the back panel is contoured to conform to a shape of at least one of the head, the shank, and the handle of the toothbrush.

8. The package of claim 1, wherein:

the front panel further comprises an outer package surface and an inner package surface; and the text and/or graphics are printed on both the outer package surface of the front panel and the inner package surface of the front panel.

* * * * *